United States Patent [19]

Schwartz

[11] Patent Number: 4,542,619

[45] Date of Patent: Sep. 24, 1985

[54] CORE YARN AND METHOD AND APPARATUS FOR MAKING

[75] Inventor: Nathan G. Schwartz, Bryn Mawr, Pa.

[73] Assignee: Techniservice Division, Textured Yarn Company, Philadelphia, Pa.

[21] Appl. No.: 553,525

[22] Filed: Nov. 21, 1983

[51] Int. Cl.[4] ..... D02G 3/36; D02G 3/38; D02G 1/20

[52] U.S. Cl. ..... 57/210; 28/247; 28/258; 28/281; 57/16; 57/18; 57/228; 57/309; 57/351

[58] Field of Search ..... 57/16–18, 57/351, 210, 309, 226, 227–229; 28/219, 220, 247, 258, 281

[56] References Cited

U.S. PATENT DOCUMENTS

| | | | |
|---|---|---|---|
| 3,643,416 | 2/1972 | Andrews et al. | 57/210 X |
| 3,675,409 | 7/1972 | Rosenstein | 57/229 |
| 3,769,787 | 11/1973 | Rosenstein et al. | 57/227 |
| 3,831,369 | 8/1974 | Northup et al. | 57/210 X |
| 4,028,874 | 6/1977 | Maag et al. | 57/210 |
| 4,346,553 | 8/1982 | Schwartz | 57/210 |

*Primary Examiner*—John Petrakes
*Attorney, Agent, or Firm*—Austin R. Miller

[57] ABSTRACT

This invention discloses a yarn, and method and apparatus for making it, composed of a core component having yarn strength wrapped clockwise and counterclockwise by wrapper components, wherein the core has a sinuous configuration and contains a greater length per unit of yarn length than the wrapper components. Optionally, the core component may be a newly texturized multi-filament yarn, wrapped according to this invention before being subjected to significant tension, thereby preserving much of the bulk that would otherwise be lost in winding or other tensioning of the texturized core in unwrapped condition.

17 Claims, 4 Drawing Figures

CORE YARN AND METHOD AND APPARATUS FOR MAKING

This invention relates to an apparatus, method and yarn product wherein a bulked continuous filament or other self-supporting yarn or yarn bundle is fed under relatively low tension through a pair of opposed oppositely rotating hollow spindles, preferably with non-rotating inner walls, and is cross-wrapped between such spindles with wrapper yarns, preferably of different color or dyeability from the core, fed under relatively high tension, producing a sinuous multi-component yarn exhibiting in the finished carpet or other product a unique texture and color distribution, substantially free from the streaks and other blemishes frequently found in such products. By optionally programmably varying the relative core and wrapper yarn tensions, pseudo-random or patterned segments of different or continuously changing sinousities can be created along the yarn length, with striking effects in the final product. The invention can be applied in-line with texturization of the core yarn, creating the additional advantages of equipment and labor cost savings, and capturing some of the bulk that would otherwise be lost in optionally air-entangling and winding up the texturized yarn.

It has long been known to create multi-color bulked continuous filament ("bcf") carpet and other yarns by space and other dyeing techniques, or by combining yarn ends of different colors or dyeabilities through mechanical twisting or air entanglement. These processes produce yarns and carpets of generally stereotyped textures and color distributions, and are prone, despite expensive quality control procedures, to streaking and other blemishes marring the appearance and value of the finished product.

Unlike these processes, the present invention creates a multi-component finished yarn in which one of the components, the single or multi-color core yarn, ordinarily predominates in most constructions. Not only is it often a heavier weight material than the wrapper yarns, but the sinuous distortion of the core in the cross-wrapping process makes it contain a proportionately longer length of yarn per finished yarn unit length than the wrapper yarns. This is not true of conventional twisting or air entangling of different color or dyeable yarn ends. The wrapper components, which likewise may be multi-color yarns themselves, normally appear in products made from yarns of this invention as flecks distributed in a non-patterned, non-streaky fashion throughout the product, rather than as continuously visible components. The randomly alternating appearance on the product surface of wrapped and unwrapped points of the core yarn contributes to a textured surface appearance strikingly different from products of the same construction made from, e.g., normal bcf yarn, apparent even when the product is made from yarns of solid color.

Cross-wrapping a zero tensile strength staple core yarn by passing it through a pair of opposed oppositely rotating hollow spindles has been done to impart tensile strength without imparting real twist, which would inhibit softness of hand, Schwartz U.S. Pat. No. 4,346,553. It is likewise known to subject otherwise non-processable multi-filament yarns and tows to hollow spindle wrapping to permit them to be readily handled in subsequent packaging operations, Rosenstein, U.S. Pat. No. 3,675,409. The present invention, however, deals with an already self-supporting and readily further processable core, which may be of a bcf yarn or alternatively a flat filament, partially oriented filament, or self-supporting spun yarn, or a combination thereof. One important purpose of wrapping it is not to achieve tensile strength or processability, which already exists, but to create the aesthetic effects of the yarn combination itself.

DRAWINGS

Figure 1:
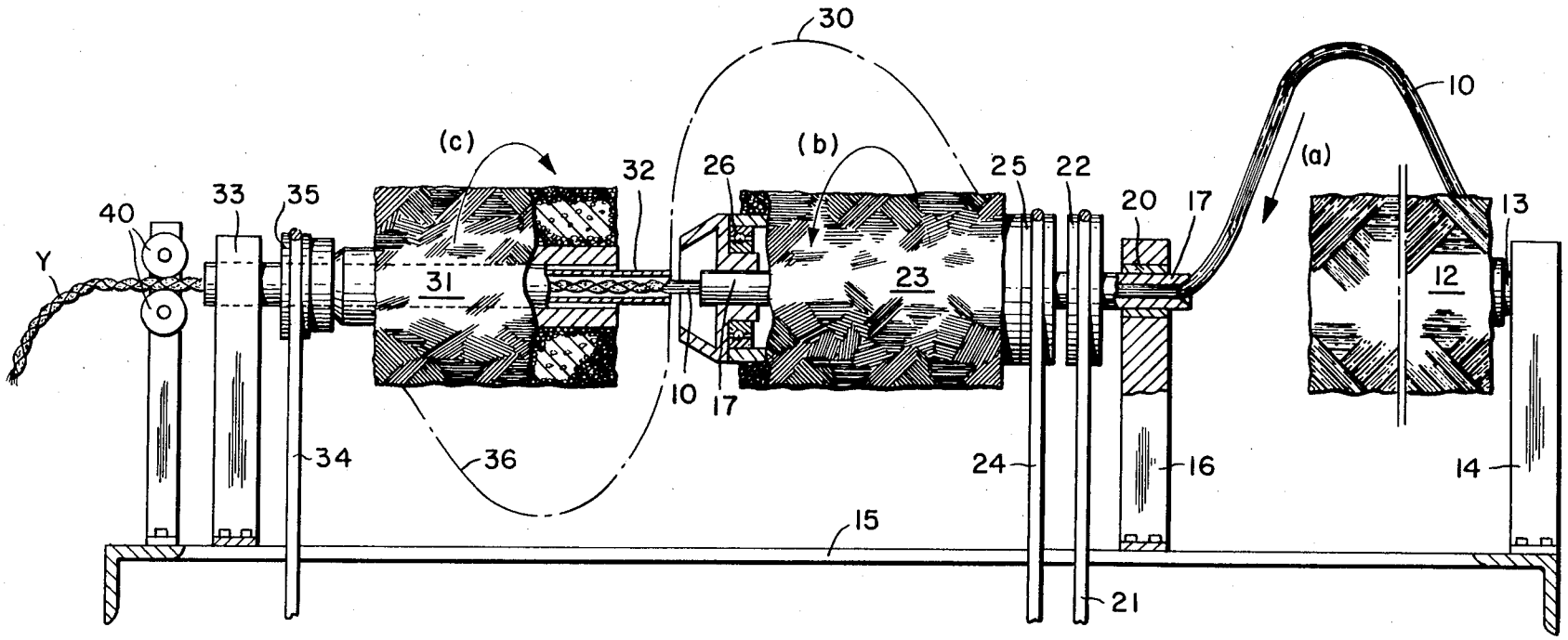
FIG. 1 is a schematic representation, in side elevation, of essential components of one form of apparatus for practicing the present invention.

The description which follows is phrased in specific terms to describe specific forms of the invention selected for illustration in the drawings. It is not intended to define or to limit the scope of the invention, which is defined in the appended claims.

Figure 3:
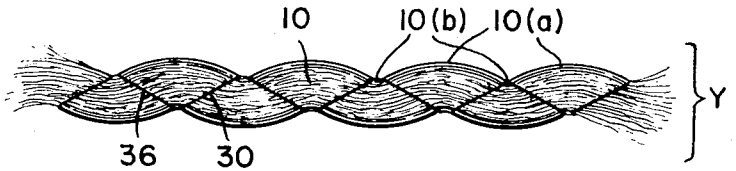
FIG. 3 is a similar view of a yarn of the present invention.
Figure 2:
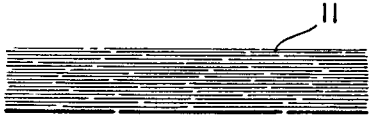
FIG. 2 is a schematic lengthwise view, enlarged and exaggerated to show the components, of a yarn core.

Referring to FIGS. 1–3, core yarn 10 is withdrawn from core yarn package 12 and optionally fed through tension gate 17 to a pair of opposed oppositely rotating hollow spindles, 23, 31. The spindles are driven by belts 24, 34, respectively, from drive apparatus not shown. Mounted on hollow spindles 17, 32, are wrapper yarn packages 23, 31, which rotate in the directions indicated by the associated arrows. The spindles are supported by mounting apparatus shown in FIG. 1.

The core yarn is passed through both hollow spindles and is withdrawn by withdrawal rolls 40, driven by means not shown. As the core yarn passes between hollow spindles 17, 32, it is wrapped at the same point in opposite directions by wrapper yarns 30, 36, withdrawn from rotating wrapper yarn packages 23, 31, respectively, in a cross-wise or "X" fashion. Thus, only core yarn 10 passes through hollow spindle 17, whereas core yarn 10 wrapped cross-wise with wrapper yarns 30, 36 passes through hollow spindle 32, forming final yarn Y. The wrapping of the core by both wrapper yarns at the same time and place results in the final yarn being essentially torque-free and balanced, at least when the two wrapper yarns are of the same weight and the hollow spindles are rotated at the same speed.

In operation, core yarn 10 should normally be fed through hollow spindles 17, 32, under as low tension as can be provided, and wrapper yarns 30, 36 wrapped around it with relatively high tension. This tension differential causes the core yarn to become distorted along its length by the wrapping action, with the wrapped yarn Y assuming a highly desirable sinuous configuration, depicted in FIG. 3. The use of wrapper yarns of relatively heavy weight in relation to the core yarn enhances this effect, as does increasing the rotational speed of the hollow spindles. However, minimizing the tension on core yarn 11 is the single most significant factor in maximizing this desirable final yarn sinuousness. In sixty experiments conducted at 7200 rpm spindle speed and 74 ypm take-up speed, using all combinations of three different weight core yarns (2450, 3675, and 4900 denier), five different weight wrapper yarns (150, 370, 720, 900, and 1225 denier), and four different core yarn input tension levels (negligible, 40, 80, and 160 grams), in no case was a high degree of sinuousness attained at 80 grams or higher input tension, even with core:binder denier ratios as low as 2:1. At 40 grams core input tension, a high degree of sinuousness was attained at a 4:1 core:binder denier ratio, and at negligible tension at 10:1. A low level of sinuousness was obtained at 80 grams at a 7:1 ratio; and at negligible tension at a 16:1 ratio. To obtain the desirable high degree of finished yarn sinuousness, therefore, core input tension should be made as low as possible.

Hollow spindle machines typically employ a hollow spindle which rotates as a unit. For practicing the present invention, however, it is highly preferable that the inner tube of the hollow spindle be stationary. When the core yarn is fed in under the lowest practical tension needed to maximize final yarn sinuousness, it is very subject to snagging and snarling when passing through a rotating inner spindle. Therefore, inner tubes 17, 32, of the hollow spindles, should remain stationary, rather than rotating with said spindles and wrapper yarn packages.

The holding of the inner tubes of hollow spindles stationary while rotating the outer shells rapidly is accomplished by means depicted in FIG. 1.

Referring to FIG. 1, the apparatus depicted in section includes a hollow spindle 26. Inner tube 17 of hollow spindle 26 is rigidly mounted in mounting block 16. Bearings are mounted in hollow spindle 18, with their inner races contacting inner tube 17. Between bearings 26 the inner diameter of hollow spindle is slightly larger than the outer diameter of inner tube 17, so that the two are not in physical contact. As belt 21 drives the hollow spindle, the latter is caused to rotate rapidly, while inner tube 17, fixedly mounted, remains stationary. Identical means are used to cause the rotation of the other hollow spindle 35, while holding its inner tube 32 stationary.

Figure 4:
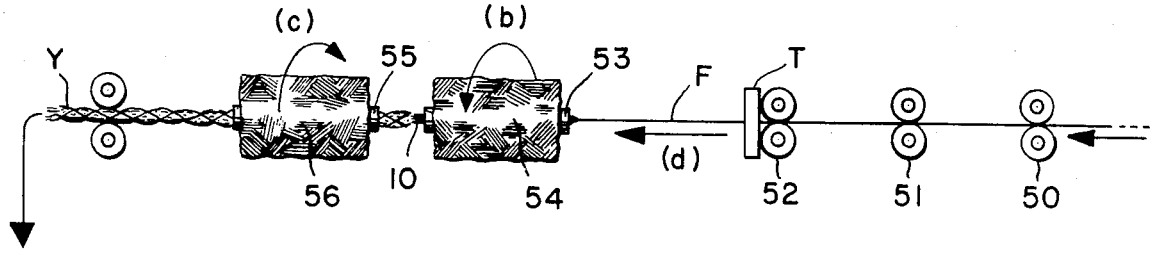
FIG. 4 is a block diagram of one form of process of draw-crimping as integrated into the present invention, performed as separate discontinuous operations.

Referring again to FIG. 1, it is possible to vary the extent of sinuosity along the length of final yarn Y by programmably varying the tension applied to core yarn 10, as by the tension device T shown in FIG. 4. Means for achieving such variation can consist, for example, of a programmable controller intermittently actuating a solenoid alternately raising and lowering the tension applying arm of a tension gate, or, alternatively, of a device for continuously varying the tension applied to the core yarn.

FIG. 4 is a diagram showing the steps of practicing draw-texturing and wrapping in a single continuous operation according to this invention. The draw rolls are 50, 51 and 52, and T designates the tension device. 54 and 56 are the wrapper yarn packages, and 53 and 55 are the spindles.

As shown in FIG. 4, the process of creating a bcf yarn from undrawn filament includes the steps of drawing, crimping, optionally entangling, and winding up. It is preferable to combine the two steps into a single continuous operation according to this invention, as shown in FIG. 4. The latter method has both economic and product quality advantages. First, the apparatus needed to wind up the texturized yarn is omitted. The yarn is fed directly into the apparatus for the present invention as the core yarn. Secondly, in texturizing bcf yarn, air entanglement is often employed as a means for making the bundle of texturized filaments cohesive for further processing, including smooth removal of the yarn from the textured yarn package itself. Both the incidental tensioning of the newly texturized yarn in directing it through the entanglement jet and the nature of the entanglement process itself rob the textured yarn of some of its initial bulk. However, the wrapper yarns of the present invention, among other effects, provide cohesiveness to the bundle of texturized core yarn filaments, often rendering the entanglement step unnecessary. Thirdly, and most strikingly, much of the bulk initially inserted into the texturized yarn bundle by the texturizing process is irretrievably lost as the crimped yarn is subjected to tensioning in being wound up. By wrapping the texturized yarn directly as it comes out of the texturizer, a large measure of this otherwise lost initial bulk can be captured and permanently held in place by the wrapper yarns even under subjection of the wrapped yarn to considerable tension, resulting in a substantially bulkier final yarn than can be achieved in a discontinuous process.

It is sometimes desirable to subject a texturized yarn to a jet treatment process known as "taslanizing", or the like, which blows loops into individual filaments and gives the bcf yarn a rougher, more spun-like appearance. This is frequently done as a separate operation on a specialized machine for this purpose. However, the process for performing the present invention is well-suited in speed and other factors for including a "taslan"-type jet in the path of the core yarn, prior to the wrapping step, and the sinuous nature of the final yarn of the present invention will in many applications exhibit in the final product the characteristics imparted by the "taslanizing" step more fully than "taslanized" normal bcf yarns.

Accordingly, this invention involves the step of wrapping a multi-filament core which is compressable or at least bendable, as contrasted to the relative incompressability and stiffness of monofilament. An important factor in achieving a sinuous multi-filament core during the wrapping stage is to provide as low as practical tension on the core yarn, facilitated by holding the inner tubes of the rotating hollow spindles stationary. This also helps prevent false twisting of the core. If a stationary inner tube is not used, then the inner diameter of the hollow spindle should be sufficiently large as to minimize snagging and snarling and also false twisting of the core yarn. Relative core throughput and hollow spindle rotational speeds also affect the degree of sinuosity attained. Preferably, the wrapper yarns should spin at extremely high rotational speeds with respect to the longitudinal speed of the core.

Although the present invention has been described with reference to particular yarns, methods, and apparatus, many variations may be made, including the substitution of equivalent elements for those expressly shown, the use of certain features independently of other features, reversals and changes of step sequences, etc., all without departing from the spirit and scope of the present invention as defined in the appended claims.

I claim:

1. A yarn composed of a self-supporting core component having yarn strength, said core component being wrapped both clockwise and counter-clockwise by wrapper components, wherein the core component has a sinuous configuration and contains a greater length of core component per unit of yarn length than the length of each of the wrapper components for the same unit of yarn length.

2. The yarn of claim 1 where the wrapper components and the core component are of different colors or dyeabilities.

3. The yarn of claim 2 containing patterned or pseudo-random segments of core sinuousness of varying intensity.

4. The yarn of claim 1 containing patterned or pseudo-randon segments of core sinuousness of varying intensity.

5. The method of wrapping a self-supporting core yarn comprising the steps of advancing it under tension through a pair of endwise opposed oppositely rotating hollow spindles on which wrapper yarns are mounted, and wrapping said wrapper yarns around the pulled and tensioned core yarn between the hollow spindles under sufficiently high tension relative to the tension of the core yarn as to cause the core yarn to assume a sinuous configuration and to include within the wrapped yarn a longer length of core per unit length of wrapped yarn than the length of each of the wrapper yarns for the same unit length of wrapped yarn.

6. The method of claim 5 including the step wherein the inner walls of the rotating hollow spindles are maintained stationary.

7. The method of claim 6 where the wrapper yarns are of different color or dyeability from the core yarn.

8. The method of claim 7 including the additional step of periodically varying the tension of the core yarn.

9. The method of claim 6 including the additional step of periodically varying the tension of the core yarn.

10. The method claim 5 where the wrapper yarns are of different color or dyeability from the core yarn.

11. The method of claim 10 including the additional step of periodically varying the tension of the core yarn.

12. The method of claim 5 including the additional step of periodically varying the tension of the core yarn.

13. Apparatus comprising a pair of opposed oppositely rotatable hollow spindles on which wrapper yarns may be mounted, and means for pulling the yarn through the spindles under tension, and the inner walls of said hollow spindles being stationary, through which core yarn may be pulled and wrapped between said spindles by said wrapper yarns, means for pulling the core yarn through the first hollow spindle under tension and for pulling the wrapped core yarn through the second hollow spindle, and control means for the rates of feed of said core yarn and said wrapper yarns to form the core yarn into a sinuous configuration containing a greater length of core yarn per unit of yarn length than the length of each of the wrapper yarns for the same unit of yarn length.

14. The apparatus of claim 13 including the addition of means for periodically varying the tension on the core yarn.

15. A method of making a wrapped sinuous yarn, comprising the steps of:

a. advancing a multi-filament compressable core yarn under a low tension (T1) through a hollow spindle in a substantially non-false twisted state;

b. wrapping the core yarn with a plurality of wrapper yarns under a tension (T2) higher than tension (T1) in both the clockwise and counter-clockwise directions around the core yarn; and c. controlling the rates of feed of said core yarn and said wrapper yarns to form the core yarn into a sinuous configuration containing a greater length of core yarns per unit of yarn length than the length of each of the wrapper yarns for the same unit of yarn length.

16. The method of preserving increased bulk inserted into a yarn by texturization or other means comprising the step of wrapping such texturized yarn in the clockwise and counter-clockwise directions with wrapper yarns, said wrapping step being performed before such yarn is wound up or subjected to substantial tension, whereby the texturized yarn is formed into a sinuous configuration containing a greater length of texturized yarn per unit of yarn length that the length of each of the wrapper yarns for the same unit of yarn length.

17. The method of claim 16 wherein such wrapping step causes such yarn to assume a sinuous configuration.

* * * * *